US006154939A

United States Patent [19]

Woedl

[11] Patent Number: 6,154,939

[45] Date of Patent: Dec. 5, 2000

[54] HANDLE ASSEMBLY FOR DECEDENT CONFINEMENT CHAMBER

[76] Inventor: Steve Woedl, 3584 Kehr Rd., Oxford, Ohio 45056

[21] Appl. No.: 09/177,313

[22] Filed: Oct. 22, 1998

[51] Int. Cl.[7] ..... A61G 17/00

[52] U.S. Cl. ..... 27/27

[58] Field of Search ..... 27/1, 2, 10, 27, 27/35; D99/7; 294/15

[56] References Cited

U.S. PATENT DOCUMENTS

| | | | |
|---|---|---|---|
| 1,833,547 | 11/1931 | Wollitz | 27/27 X |
| 2,106,695 | 1/1938 | Larson | 27/10 |
| 3,025,624 | 3/1962 | Harrell | 27/1 |
| 4,372,018 | 2/1983 | Miller, IV et al. . | |
| 4,730,370 | 3/1988 | Elder . | |
| 4,788,757 | 12/1988 | Bethune et al. . | |
| 5,088,167 | 2/1992 | Rahe | 27/1 |
| 5,463,800 | 11/1995 | Rojdev | 27/27 X |
| 5,533,241 | 7/1996 | McConnell | 27/27 |
| 5,604,965 | 2/1997 | Shaw et al. | 27/2 |
| 5,689,869 | 11/1997 | Linville et al. | 27/27 X |
| 5,898,980 | 5/1999 | Havranek et al. | 27/27 |

FOREIGN PATENT DOCUMENTS 2 003 835 3/1979 United Kingdom .

*Primary Examiner*—Terry Lee Melius
*Assistant Examiner*—William L. Miller

[57] ABSTRACT

An inexpensive decorative handle assembly for carrying a decedent confinement chamber, such as a casket or coffin, comprising a bar, and a plurality of end caps consisting of a bar restraint and a fastener, and at least one decorative aspect. One end of the bar fits within each bar recess preventing the bar from moving with respect to the end caps. The decedent confinement chamber is adapted to mate with each fastener, thereby preventing the end caps from moving with respect to the chamber, and thus securing the bar to the chamber, forming a handle. The decorative handle assembly further comprises one or more of a variety of decorative aspects including, but not limited to, decorative lugs and decorative corner pieces.

14 Claims, 10 Drawing Sheets

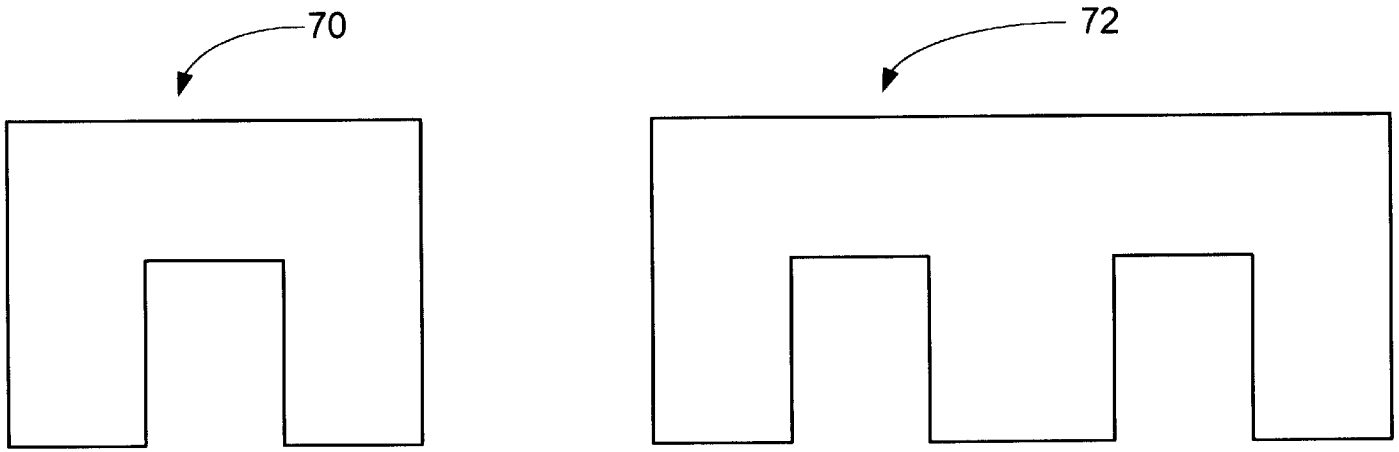
Fig. 7A
Fig. 7B
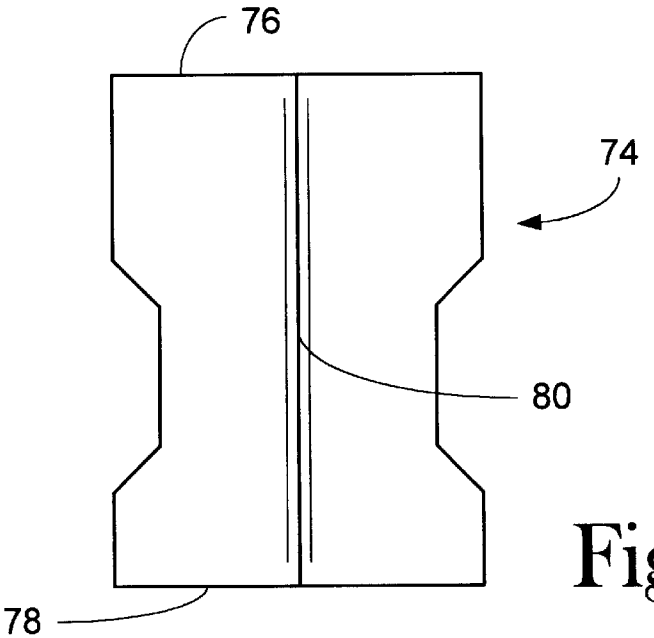
Fig. 7C

HANDLE ASSEMBLY FOR DECEDENT CONFINEMENT CHAMBER

FIELD OF THE INVENTION

The invention relates to a decorative handle assembly for a decent confinement chamber. The term "decedent confinement chamber" as used herein refers to a casket or coffin. The invention further relates to a decedent confinement chamber containing such handle assembly and the appropriate decorations.

BACKGROUND OF THE INVENTION

In manufacturing a decedent confinement chamber, care must be taken to ensure that the decedent confinement chamber contains a carrying means. Usually, handles are manufactured comprising handholds that run lengthwise along the longer perimeter of the decedent confinement chamber. These handles allow multiple persons to help carry the decedent confinement chamber. In addition, these handles may run along the ends of the decedent confinement chamber. Finally, numerous decorative aspects can be incorporated with great effort. Fashioning separate handles and decorative aspects requires additional time and expense. Fashioning an easy-to-attach decorative handle for use on decedent confinement chambers would be useful. Usually, the decorative aspects are made specifically for a decedent confinement chamber and are not interchangeable.

SUMMARY OF THE INVENTION

The present invention provides an inexpensive decorative handle assembly for a decedent confinement chamber. Further, the present invention provides for easily interchangeable decorative aspects including, but not limited to, decorative lugs and decorative corner pieces, for the decedent confinement chamber.

In the preferred embodiment, the decorative handle assembly of the invention comprises at least a horizontal bar, a plurality of end caps, a fastener, and a decorative aspect. The end caps have an internal recessed chambers for insertion of the bar which thereby prevents the bar from moving with respect to the end cap. The decedent confinement chamber is adapted to mate with each fastener, thereby preventing the end caps from moving with respect to the decedent confinement chamber, and thus securing the bar to the decedent confinement chamber. Finally, the decedent confinement chamber is further adorned with at least one decorative aspect described below.

In another embodiment, the decorative handle assembly of the invention further comprises one or more slide throughs. The slide throughs are adapted to capture the bar at a point between the end caps and prevent the bar from moving with respect to the slide through. The decedent confinement chamber is adapted to mate with each slide through and prevent movement of each slide through with respect to the decedent confinement chamber, thereby further securing the bar to the decedent confinement chamber and strengthening the decorative handle assembly.

In the preferred embodiment, the slide through comprises a stud adapted to be secured in a preformed opening in the decedent confinement chamber. The stud is secured with a nut. Relatedly, the end caps are attached to the decedent confinement chamber in a similar manner. Additionally, the decorative handle assembly further contains at least one decorative lug and/or at least one decorative corner flange. The lug or flange may be attached to the face of the decedent confinement chamber by snap-on means, slide-on means, or friction-fit means.

In still another embodiment, the invention relates to a decedent confinement chamber containing the decorative handle assembly discussed above.

DESCRIPTION OF THE DRAWINGS

FIG. 7A is a front view of a single slotted lug (70), FIG. 7B is a front view of a double slotted lug (72), and FIG. 7C is a front view of a corner flange (74) of the invention;

FIG. 11 is a frontal view showing the attachment of a single slotted lug to a decedent confinement chamber utilizing at least one slide through; and FIG. 12 is a front perspective view showing attachment of a single slotted log (and a corner flange) to a decedent confinement chamber utilizing at least one slide through.

DETAILED DESCRIPTION OF THE INVENTION

In the preferred embodiment, the decorative handle assembly of the invention comprises a horizontal bar, typically measuring about one inch in width, which is normally composed of steel, wood, or aluminum. The length of the bar is typically ⅞ of the length of the attaching side of the decedent confinement chamber.

Figure 1A:
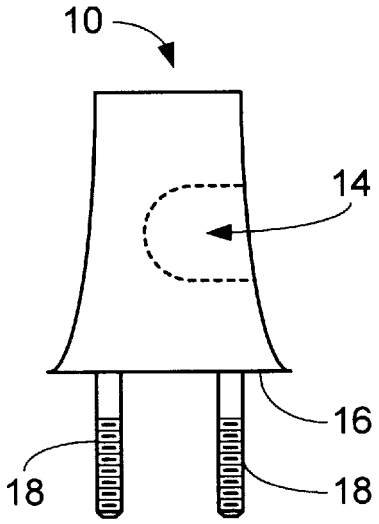
FIG. 1A and FIG. 1B are top views of an end cap of the invention showing the recessed interior.
Figure 1B:
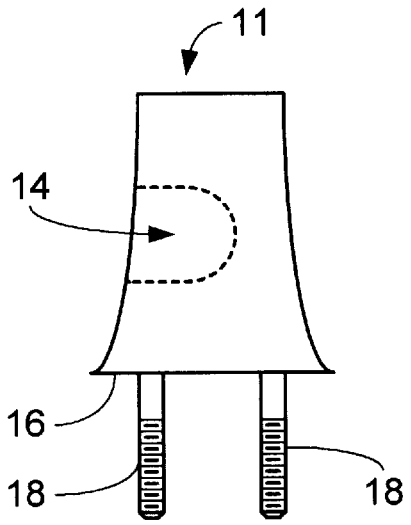

The decorative handle assembly of the invention also comprises a right end cap 10 and a left end cap 11, shown in FIG. 1(*a*) and FIG. 1(*b*), respectively, both having recesses 14, a side panel 16 for interfacing with the decedent confinement chamber, and studs 18. The recessed chamber extends from one side of the end cap to the interior of the end cap.

Figure 2:
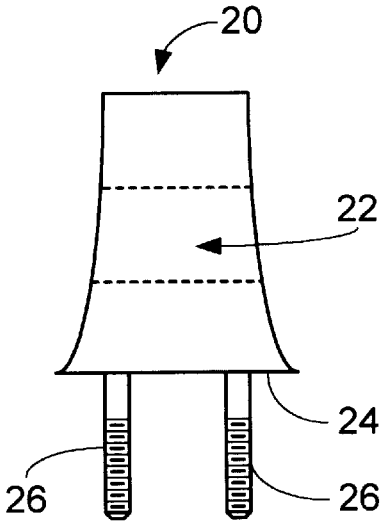
FIG. 2 is a top view of a slide through of the invention showing the recessed interior.

For handles of longer lengths, the decorative handle assembly further comprises one or more slide throughs 20, as shown in FIG. 2. Slide through 20 has a cavity 22 extending through both sides of the slide through for insertion of the horizontal bar, a side panel interface 24, and studs 26. End caps 10 and slide throughs 20 may be produced by an injection molding process to minimize the cost of manufacture.

Figure 3:
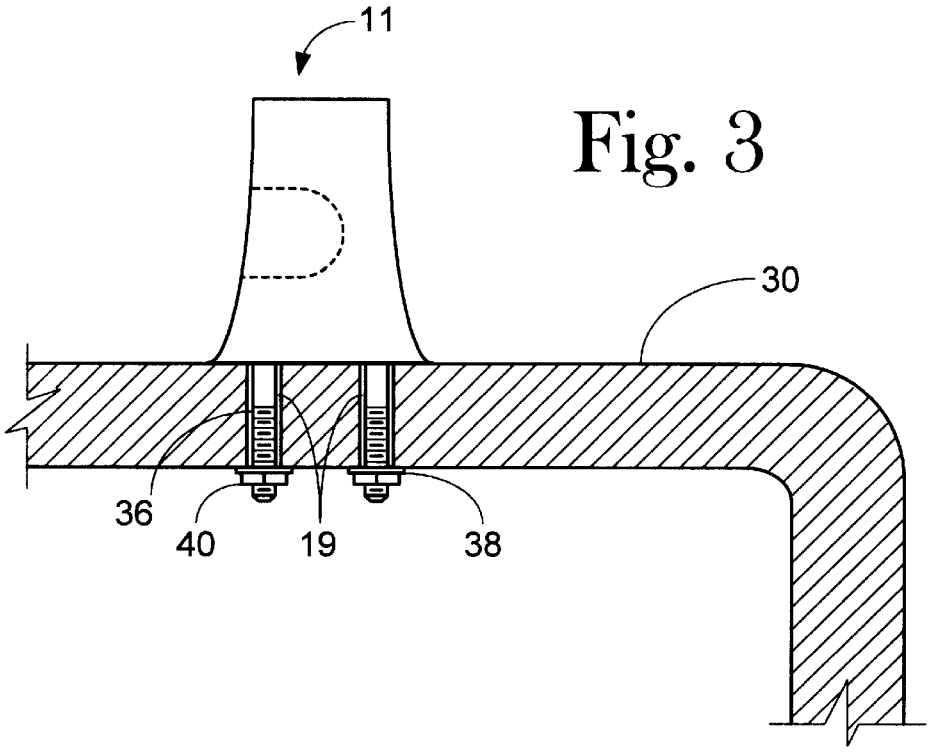
FIG. 3 is a sectional view showing the attachment of the end cap to a decedent confinement chamber.

FIG. 3 illustrates the attachment of a left end cap 11 of the decorative handle assembly onto a planar face of decedent confinement chamber 30. End cap 11 is attached to face of decedent confinement chamber 30 via preformed stud holes 19 in the chamber. The preformed stud holes 19 allow attachment of end cap 11 to the decedent confinement chamber. In a preferred embodiment, receiving studs 36 are used in stud holes 19. Washer 38 is placed on stud 36, and bonded via fitting nut 40. Thus, end cap 11 is securely attached to decedent confinement chamber 30. In another embodiment, a push-type nut can be used with a threadless stud to attach end cap 11 to the face of decedent confinement chamber 30. In addition to the means described above, several ways exist in the art for attaching a stud like projection to an indentation or hole in a solid surface. The invention could include the usage of any of these alternative attachment methods.

Figure 4:
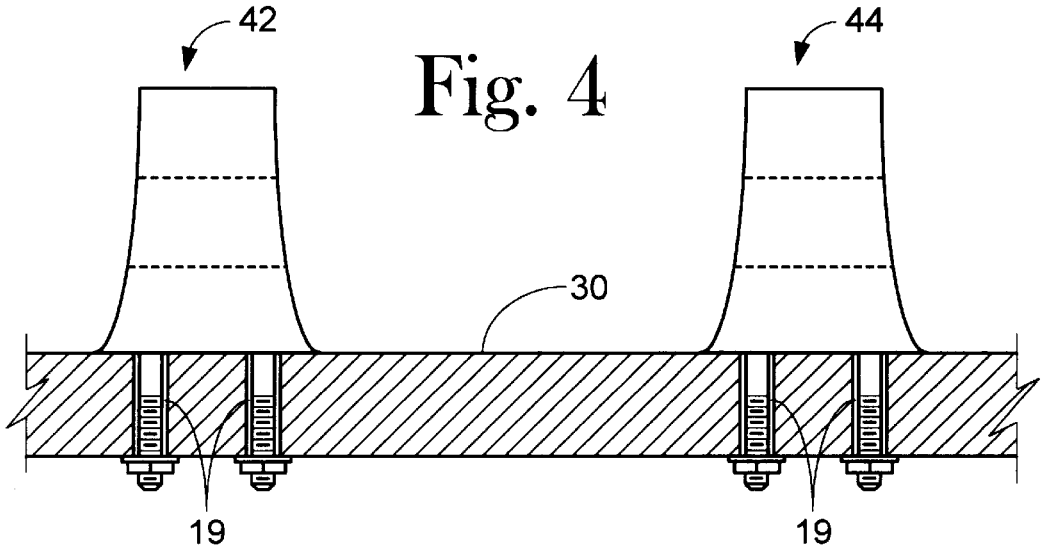
FIG. 4 is a top view showing the attachment of slide throughs to a decedent confinement chamber.

In a similar manner, slide throughs 42 and 44 are attached in a similar manner to decedent confinement chamber 40, as illustrated in FIG. 4.

Figure 5:
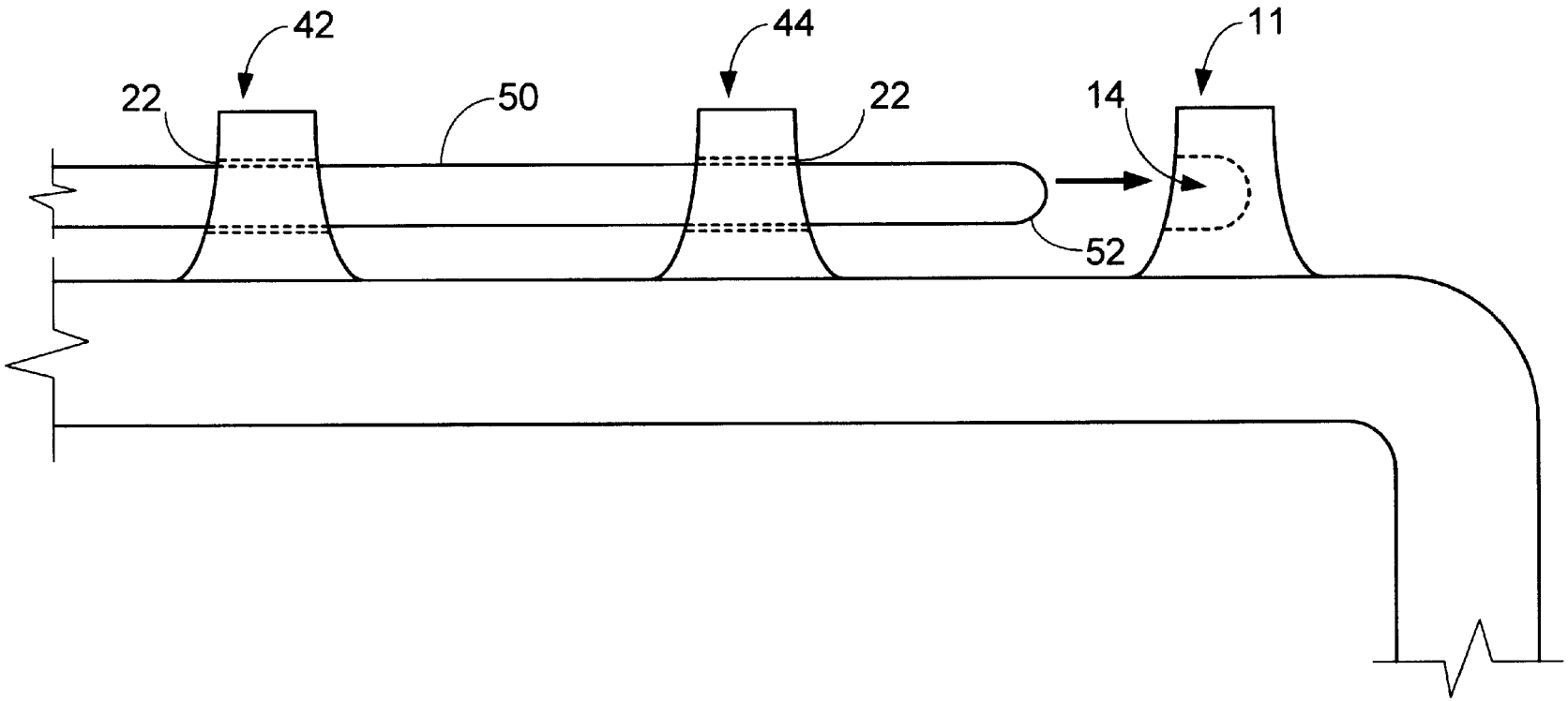
FIG. 5 is a top view showing the relationship of the handle bar to the recessed interiors of the end caps and the slide throughs.

In FIG. 5, handle bar 50 is inserted through cavities 22 of slide throughs 42 and 44.

Handle bar 50 is moved towards end cap 11 until the end 52 of handle bar 50 rests in recess 14 of end cap 11. End cap 11 is preferably constructed such that end 52 of bar 50 is not visible when viewed from an end perspective.

Figure 6:
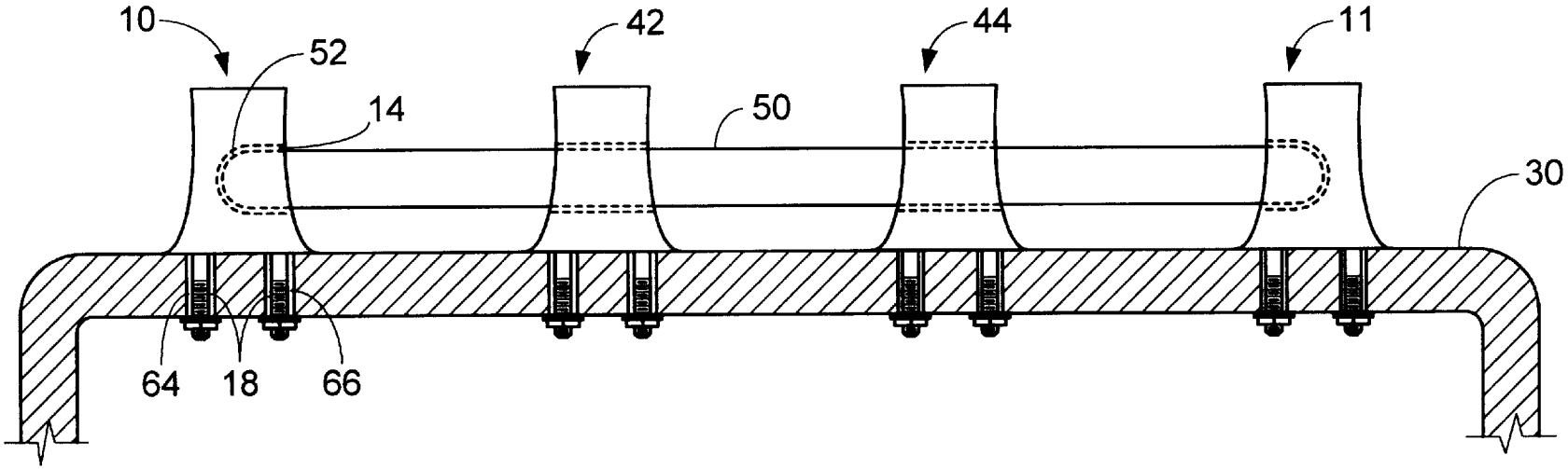
FIG. 6 is a top view showing the decorative handle assembly of the invention.

In the final step, recess 14 of end cap 10 is moved towards end 64 of handle bar 50 in FIG. 6. The length of handle bar 50, the dimensions of end cap 10, and preformed stud holes 64 and 66 are all designed to allow end cap 10 to snugly restrain handle bar 50 from movement while at the same time allowing studs 18 of end cap 10 to rest in preformed stud holes 64 and 66. When studs 18 of end cap 10 are restrained, by nuts 68 in the preferred embodiment, the resulting structure of end caps 11 and 10, slide throughs 42 and 44, and handle bar 50 comprise an inexpensive, readily assembled, and sturdy carrying handle for decedent confinement chamber 30.

End caps 10 and 11 and slide throughs 42 and 44 can also be manufactured in a number of ways to enhance the appearance of decedent confinement chamber 30. End caps 10 and 11 may be color molded to match or color molded to complement the color of decedent confinement chamber 30. Additionally, end caps 10 and 11 can be metallized in a manner to match or complement the appearance of decedent confinement chamber 30.

In a preferred embodiment, the invention also comprises decorative aspects for the handle unit. Decorative lugs and corner flanges can offset or match other decorative components of the decedent confinement chamber.

FIG. 7(*a*) shows a single slotted lug 70, FIG. 7(*b*) shows a double slotted lug 72, and FIG. 7(*c*) shows a corner flange 74 other means subject only to the functionality described below. The flanges and lugs can be color-molded, vacuum metallized, decorated with labels, or decorated with hot stamp film.

Figure 8:
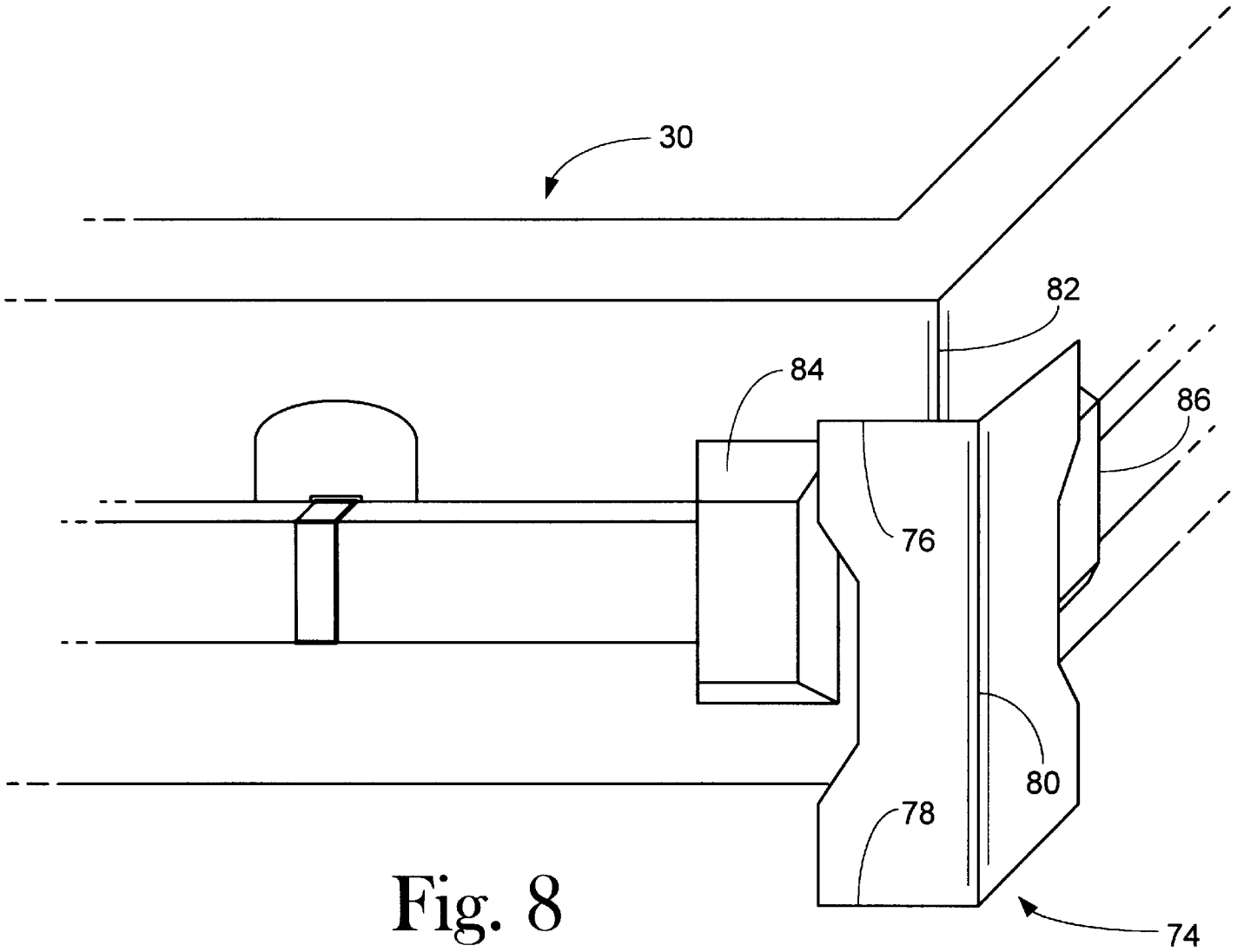
FIG. 8 is a side view showing the attachment of a decorative corner flange to a decedent confinement chamber.
Figure 9:
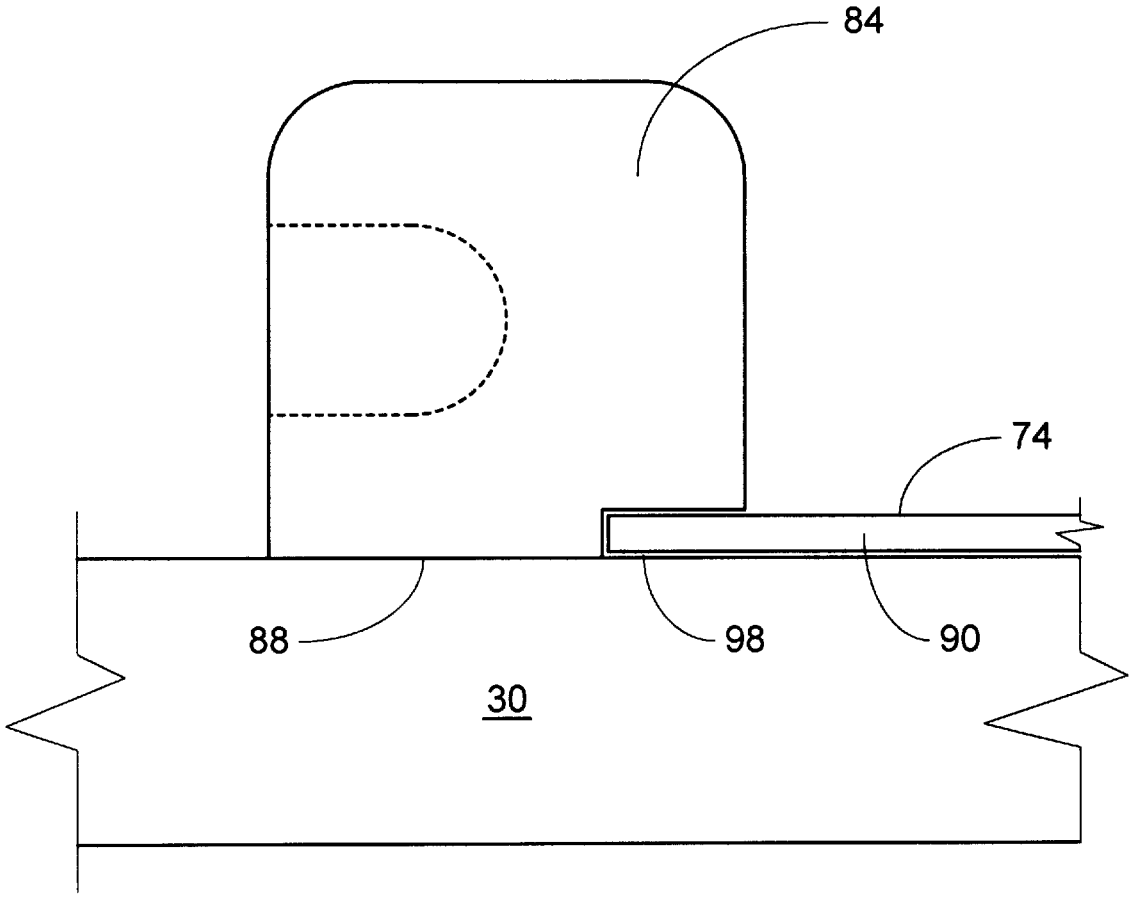
FIG. 9 is a top view showing the relationship between an end cap, a decedent confinement chamber, and a corner flange.

FIGS. 8 and 9 show the attachment of corner flange 74 to decedent confinement chamber 30. Corner flange 74 comprises top body 76, bottom body 78, and center bend 80 running the length of corner flange 74. Center bend 80 is designed to fit decedent confinement chamber corner 82. Bottom body 78 is designed to fit onto face panel 84 and side panel 86 of decedent confinement chamber 30. Typically, bottom body 78 is squeezed or bent to fit decedent confinement chamber corner 82. After positioning corner flange 74 on decedent confinement chamber 30, pressure on bottom body 78 is released. The spring force of the released corner flange 74 locks corner flange into position on face panel 84 and side panel 86. Incidentally, corner flange 74 may have top body 76 and bottom body 78 of different dimensions, but a larger top body 76 is preferable.

In a preferred embodiment detailed in FIG. 9, a partial cut-out 90 in the lower right corner of face panel 84 creates a locking fit with corner flange 74. This locking fit configuration can also be used on the top portion of face panel 84.

Figure 10:
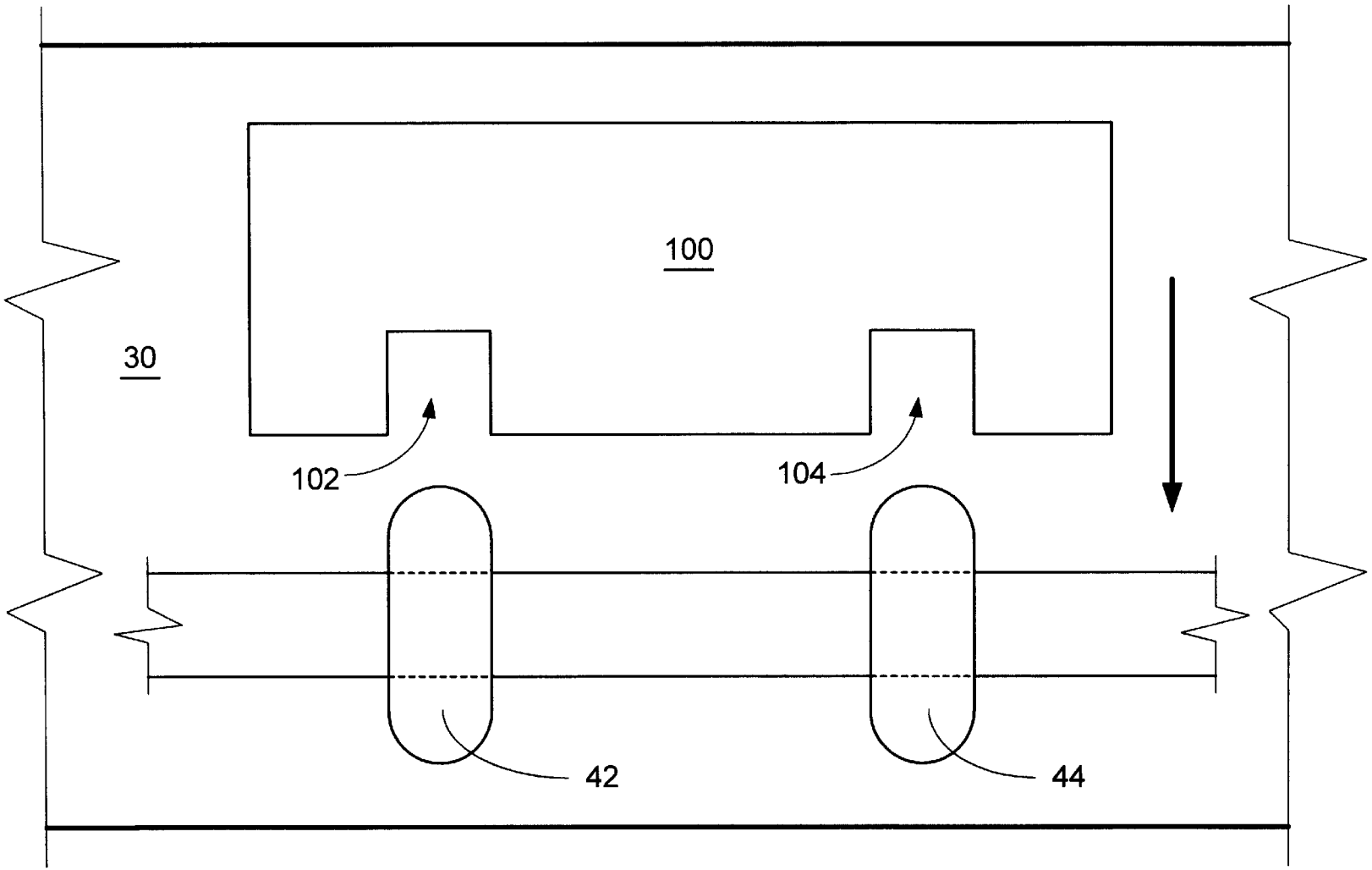
FIG. 10 is a frontal view showing the attachment of a double slotted lug to a decedent confinement chamber utilizing at least two slide throughs.

FIG. 10 shows the attachment of lug 100 to decedent confinement chamber 30. A recessed opening receptor 104 in lug 100 interlocks with at least one slide through. Lug 100 is slid down the external face of decedent confinement chamber 30 and recesses 102 and 104 are interlocked with the tops of slide throughs 42 and 44. By preferably manufacturing recesses 102 and 104 with dimensions slightly less than the respective slide throughs, lugs 100 may be securely attached to slide throughs 42 and 44 by a simple hand movement and the force of friction between recesses 102 and 104 and slide throughs 42 and 44. Attachment can be performed by snap-on or slide-on means alternatively.

Figure 11:
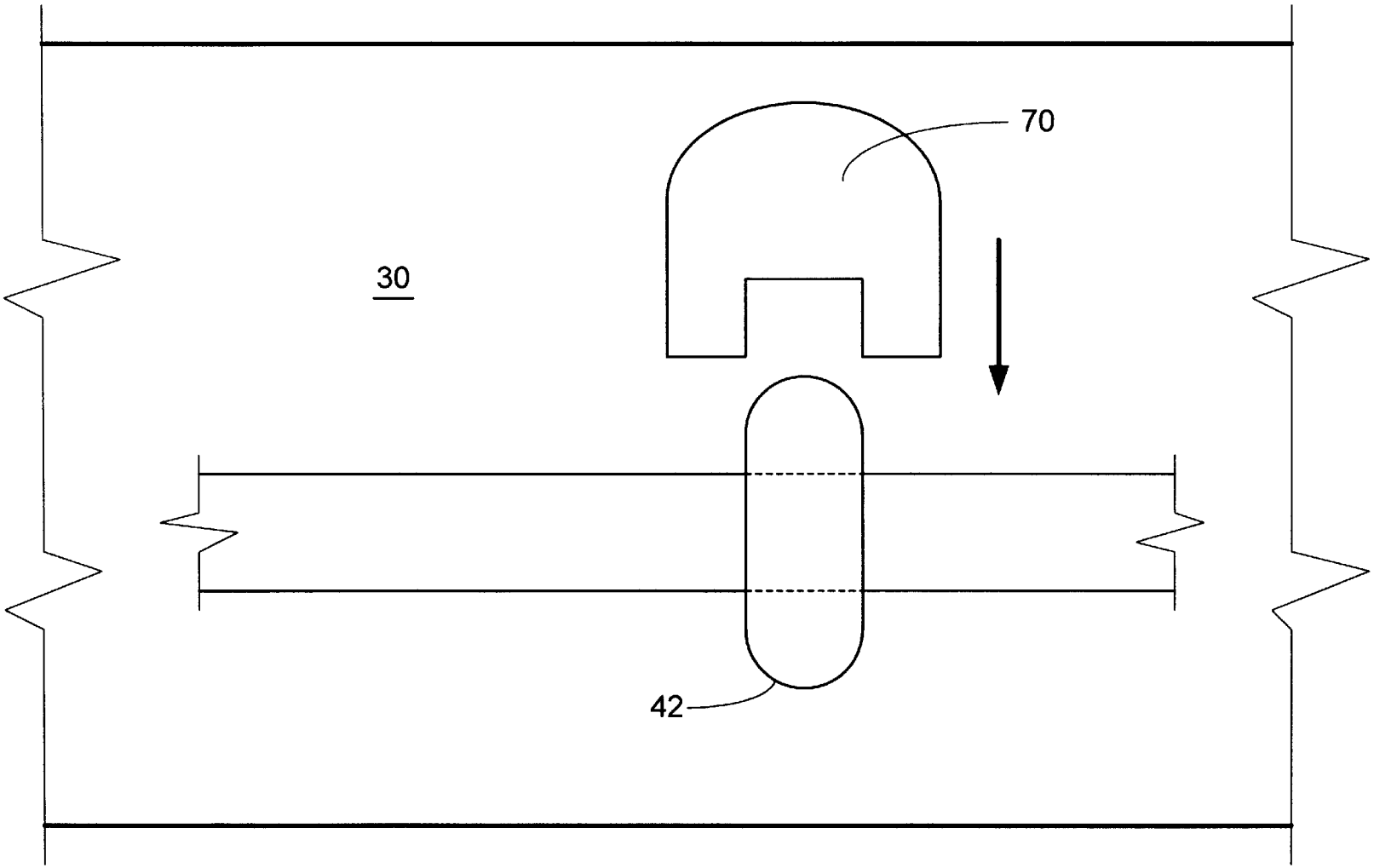

Specifically, FIG. 11 shows attachment of single slotted lug 70 to decedent confinement chamber 30. Single slotted lug 70 is designed to friction fit to slide through 42 using the previously described method.

Figure 12:
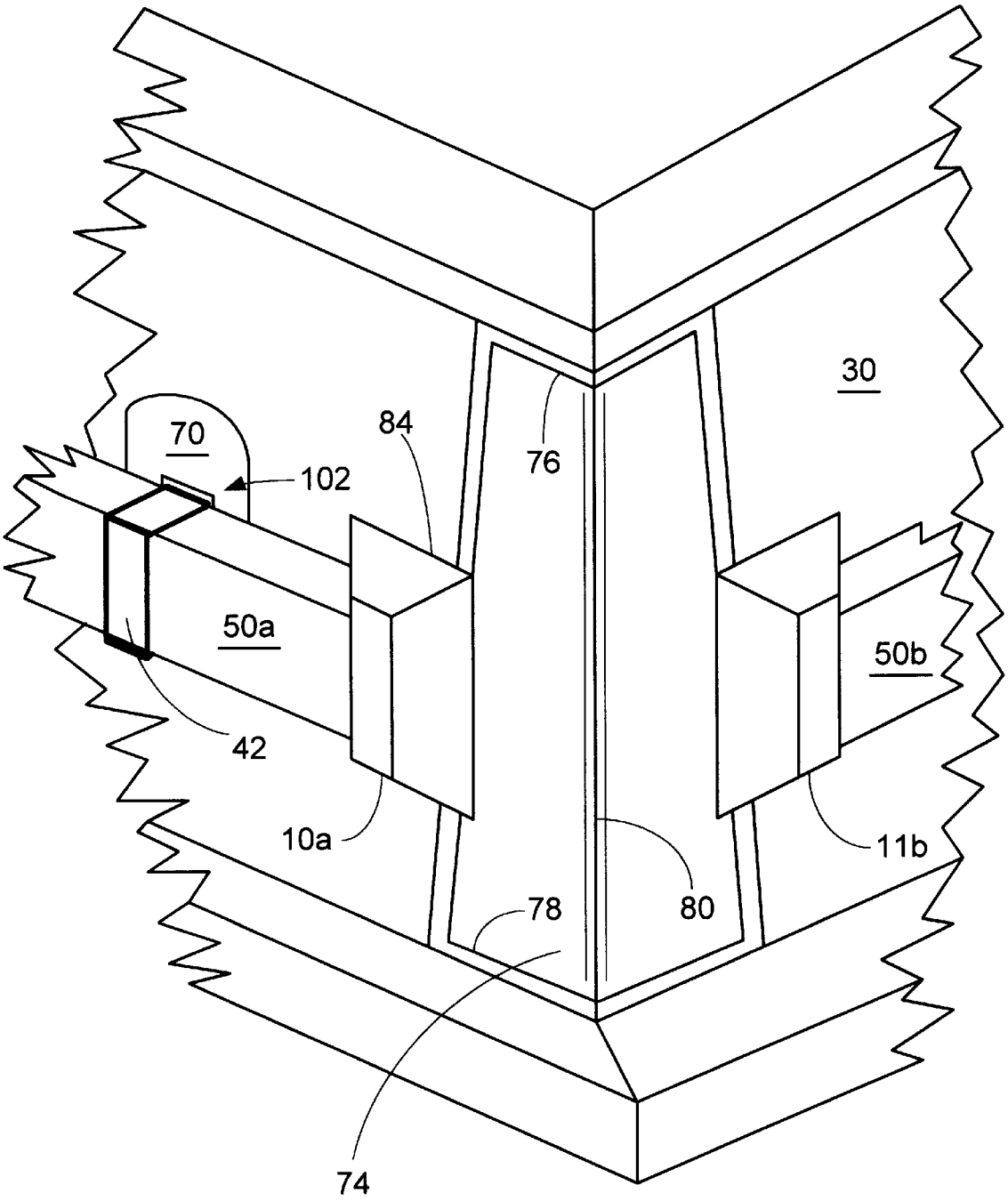

In a preferred embodiment, detailed in FIG. 12, corner flange 74 with center bend 80 is shaped to fit snugly between right endcap 10*a* and left endcap 11*b*. In addition to the friction fit between right end cap 10(*a*) and left end cap 11(*b*), corner flange 74 is affixed by previously described means to decedent confinement chamber 30. FIG. 12 also shows at least one single slotted lug 70 friction fitted to the corresponding slide through 42.

The foregoing illustrations depict the practice of the present invention in its preferred embodiments. Numerous variations and modifications may be effected without departing from the true spirit and scope of the novel concepts of the invention. Other embodiments within the scope of the claims herein will be apparent to one skilled in the art from consideration of the specification and practice of the invention as disclosed herein. It is intended that the specification be considered exemplary only with the scope and spirit of the invention being indicated by the claims that follow.

I claim:

1. A decorative handle assembly for a decedent confinement chamber comprising:

a horizontal bar having two ends;

a right and left end cap, each having recessed interiors for the ends of the horizontal bar;

a plurality of fasteners for securing the left and right end caps to the decedent confinement chamber;

one or more slide throughs, each having a cavity for holding the horizontal bar; and at least one decorative lug having a recessed receptor for interlocking with at least one or more of the slide throughs.

2. The decorative assembly of claim 1, wherein the slide through further comprises at least one stud for securing the slide through to the decedent confinement chamber.

3. The decorative handle assembly of claim 2, comprising at least two of the decorative lugs for interlocking with at least two of the slide throughs.

4. The decorative handle assembly of claim 1, wherein the fasteners are studs.

5. The decorative handle assembly of claim 1, further comprising at least one decorative corner flange wherein the decorative corner flange has a portion of the decorative corner flange for fitting with a face panel of the decedent confinement chamber, a portion of the decorative corner flange for fitting with a side panel of the decedent confinement chamber, and a center bend dividing the face panel portion from the side panel portion.

6. A decorative handle assembly for a decedent confinement chamber comprising:

a horizontal bar having two ends;

a right and left end cap, each having interiors for the ends of the horizontal bar;

a plurality of fasteners for securing the left and right end caps to the decedent confinement chamber;

one or more slide throughs, each having a cavity for holding the horizontal bar;

at least one decorative lug having a recessed receptor for interlocking with at least one or more of the slide throughs; and at least one decorative corner flange.

7. The decorative assembly of claim 6, wherein the slide through further comprises at least one stud for securing the slide through to the decedent confinement chamber.

8. The decorative handle assembly of claim 6, wherein the fasteners are studs.

9. The decorative handle assembly of claim 6, comprising at least two of the decorative lugs for interlocking with at least two of the slide throughs.

10. The decorative handle assembly of claim 6, further comprising at least two of the decorative corner flanges.

11. A casket assembly comprising:

(a) a casket surround including a bottom, side walls, end walls, and a lid moveable between a raised, open position and a lowered, closed position; and (b) a decorative handle assembly secured to the casket surround, the assembly comprising:

a horizontal bar having two ends;

a right and left end cap, each having interiors for the ends of the horizontal bar;

a plurality of fasteners for securing the left and right end caps to the walls of the casket surround;

at least one decorative corner flange; one or more slide throughs, each having a cavity for holding the horizontal bar; and wherein at least one of the side walls of the casket surround has at least one decorative lug having a recessed receptor for interlocking with at least one or more of the slide throughs.

12. The casket assembly of claim 11, wherein the slide through further comprises at least one stud for securing the slide through to the casket.

13. The casket assembly of claim 11, wherein at least one of the side walls has at least two of the decorative lugs for interlocking, with at least two of the slide throughs.

14. The casket assembly of claim 11, wherein the decorative corner flange has a portion of the decorative corner flange fitting with one of the side walls of the casket surround, a portion of the decorative corner flange fitting with one of the end walls of the casket surround, and a center bend dividing the side wall portion from the end wall portion.

* * * * *